US007134634B2

(12) United States Patent
Jeon et al.

(10) Patent No.: US 7,134,634 B2
(45) Date of Patent: Nov. 14, 2006

(54) COLUMN UNIT

(75) Inventors: Young-Sang Jeon, ChungChungnam-Do (KR); In-Sun Jang, Kwanmyong-Si (KR)

(73) Assignee: Samhongsa Co., Ltd., Seoul (KR)

( * ) Notice: Subject to any disclaimer, the term of this patent is extended or adjusted under 35 U.S.C. 154(b) by 760 days.

(21) Appl. No.: 09/861,540

(22) Filed: May 22, 2001

(65) Prior Publication Data

US 2002/0109052 A1 Aug. 15, 2002

(30) Foreign Application Priority Data

Feb. 15, 2001 (KR) ..... 2001-7524
Feb. 19, 2001 (KR) ..... 2001-4114
Apr. 20, 2001 (KR) ..... 2001-21272

(51) Int. Cl.
*F16M 11/00* (2006.01)

(52) U.S. Cl. ..... 248/161; 248/188.1; 248/188.5; 297/345; 108/144

(58) Field of Classification Search ..... 248/188.5, 248/631, 157, 161, 188.8, 404, 406.1, 158, 248/418, 622, 132, 414, 188.1, 188.2, 188.3; 297/345, 344.19, 344.16; 108/144, 150; 403/34, 35, 109.1
See application file for complete search history.

(56) References Cited

U.S. PATENT DOCUMENTS 2,961,260 A * 11/1960 Newlin ..... 248/161
4,183,689 A * 1/1980 Wirges et al. ..... 108/147
4,778,137 A * 10/1988 Watkins ..... 248/161
4,842,238 A * 6/1989 Toiyama ..... 188/322.17
5,078,351 A * 1/1992 Gualtieri ..... 188/300
5,377,942 A * 1/1995 Knopp et al. ..... 248/161
5,461,965 A * 10/1995 Schwaegerle ..... 91/408
5,462,248 A * 10/1995 Bauer ..... 248/161
5,497,966 A * 3/1996 Fuhrmann ..... 248/161
5,531,413 A * 7/1996 Wolf et al. ..... 248/188.2
5,738,318 A * 4/1998 Thole et al. ..... 248/161
5,765,804 A * 6/1998 Stumpf et al. ..... 248/161
5,806,828 A * 9/1998 Rothe et al. ..... 248/631
5,944,290 A * 8/1999 Fuhrmann et al. ..... 248/161
5,992,815 A * 11/1999 Metzdorf et al. ..... 248/631

* cited by examiner

*Primary Examiner*—Kimberly Wood
(74) *Attorney, Agent, or Firm*—Greenblum & Bernstein, P.L.C.

(57) ABSTRACT

The present invention relates to a column unit which connects a chair sheet to a base in which a wheel is installed. The present invention provides a column unit which comprises a base tube having a lower end portion vertically fixed to a base of a chair and having the hollow interior; a spindle having the interior filled with a pressure gas and divided to upper and lower chambers by a piston, an upper end portion of a piston rod being connected to the piston, a lower end portion of the piston rod being rotatably installed at the lower end portion of the inner side of the base tube, the upper and lower chambers are communicated by a bypass, a valve being installed at the bypass; and a guide sleeve installed between the base tube and the spindle and engaged with the spindle to be integrally moved upward and downward together with the spindle.

9 Claims, 10 Drawing Sheets

COLUMN UNIT

BACKGROUND OF THE INVENTION

1. Field of the Invention

The present invention relates to a column unit which connects a chair sheet to a base at which a wheel is installed, and more particularly to a column unit which is designed to regulate the height of a chair.

2. Description of the Prior Art

Generally, a known column unit applied to a chair has a structure in which a gas cylinder is installed in the interior of a base tub. A piston rod of the gas cylinder is rotatably installed at a support plate which seals the lower portion of the base tube by using a ball bearing. A piston installed at the end portion of the upper portion of the piston rod is located in the spindle of the gas cylinder. The interior of the spindle is filled with a pressure gas to perform the function of the gas cylinder. Even when the spindle is moved upward and downward along the piston rod, the pressure gas of the spindle is not discharged. The spindle is divided to upper and lower chambers by the piston. Holes are formed in the chambers to be connected by a bypass channel. A control valve and a control pin which controls the opening/closing operation of the valve are installed in the hole formed in the upper chamber. A chair sheet is positioned at the upper portion of the spindle. A chair base to which a wheel is conventionally mounted is installed at the lower portion of the base tube.

The column unit for a chair comprises the base tube and the gas spindle. The spindle of the gas cylinder is moved upward and downward to regulate the height of the chair sheet. When a user presses the control [pin to open the control valve in the state in which the spindle is located at the lowest position, the upper and lower chambers of the spindle are connected through the two holes and the bypass channel and the pressure gas in the spindle pushes the piston towards the lower position of the spindle to raise the spindle along the piston rod. To the contrary, if a force which exceeds the force of the pressure gas is applied from the upper portion of the spindle in the state in which the control pin is pressed, the spindle is moved downward. The user suitably can regulate the operation of the column unit to regulate the height of the chair sheet. The user can feel the cushion when the user is sat on the chair by the effect of the gas cylinder.

If the length of the piston rod is increased to increase the stroke of the spindle, the area by which the spindle and the tube guide makes contact with each other, i.e., the area by which the tube guide supports the spindle becomes smaller. In case a moment is applied to the upper portion of the spindle, the operation of the column unit becomes unstable or the base tube or the tube guide can be damaged by the load of the moment.

In order to settle the above-mentioned problems, a column unit for a chair is disclosed in U.S. Pat. No. 5,377,942. The patent installs a guide sleeve between the base tube and the spindle.

The patent installs a support ring which is moved upward and downward together with the spindle at the lower end portion of the spindle. An annular recess is formed in the interior of the guide sleeve from the lower side thereof to a predetermined height. If the support ring is raised as the spindle is raised and is caught by the upper end portion of the annular recess, the guide sleeve is raised together with the spindle from then. In case the spindle is moved downward to the lower side, the upper end portion of the guide sleeve is caught by another support ring installed in the spindle and is moved downward together with the spindle.

On the other hand, the patent discloses another preferred embodiment in which a guide sleeve is moved upward and downward together with a spindle by using a pulley and a pulley device.

According to the conventional column unit, in case the spindle is reciprocally moved, the frictional force between the outer surface of the spindle and the inner surface of the guide sleeve moves the spindle upward and downward or the frictional force is not sufficiently generated. As a result, in case two support rings installed at a predetermined position of the spindle and the upper end portion of the guide sleeve is raised, the upper end portion of an annular recess formed on the inner side thereof is moved upward and downward.

In case the frictional force is not sufficiently generated, after the support ring is caught at a predetermined position of the guide sleeve, the guide sleeve is moved. Therefore, in order to regulate the height only to the position, the guide sleeve is not raised and the guide sleeve cannot accomplish its function and the noise is generated when the support ring is caught.

Further, according to the conventional column unit, the number of parts is increased and thus the manufacturing cost is increased. And, the tolerances of the tube guide and the guide sleeve is simultaneously managed, and thus the inferiority rate is increased.

SUMMARY OF THE INVENTION

The present invention has been made to solve the above-mentioned problem, and accordingly it is an object of the present invention to provide a column unit which has a guide sleeve which is integrally moved upward and downward together with a spindle when the guide sleeve guides and mechanically supports the spindle.

It is another object of the present invention to install a bushing installed at a position higher than a base tube on the outer surface of the spindle and to smoothly move the spindle upward and downward by supplying a lubricant to a portion at which the friction is generated.

It is another object of the present invention to prolong the life of the column unit by fitting an auxiliary metal pipe to a tube guide inserted into the base tube.

The present invention relates a column unit, and more particularly to a telescopic column unit which enables a spindle to performed a long stroke and smoothly accomplish the operation of the spindle. A guide sleeve is mounted to the outer surface of the spindle to integrally move upward and downward the spindle. A bushing coated with a lubricant is installed on the inner surface higher than the height of the base tube on the outer surface of the guide sleeve to guide the upward and downward movement of the spindle and the guide sleeve and supplement the mechanical supporting force. The damage of the tube guide is prevented by inserting the metal tube guide on the inner surface from the upper end of the base tube to prolong the life of the column unit.

BRIEF DESCRIPTION OF THE DRAWINGS

The above and other objects and advantages of the present invention will become readily apparent by reference to the following detailed description when considered in conjunction with the accompanying drawings wherein.

DETAILED DESCRIPTION OF THE PREFERRED EMBODIMENT

Figure 1:
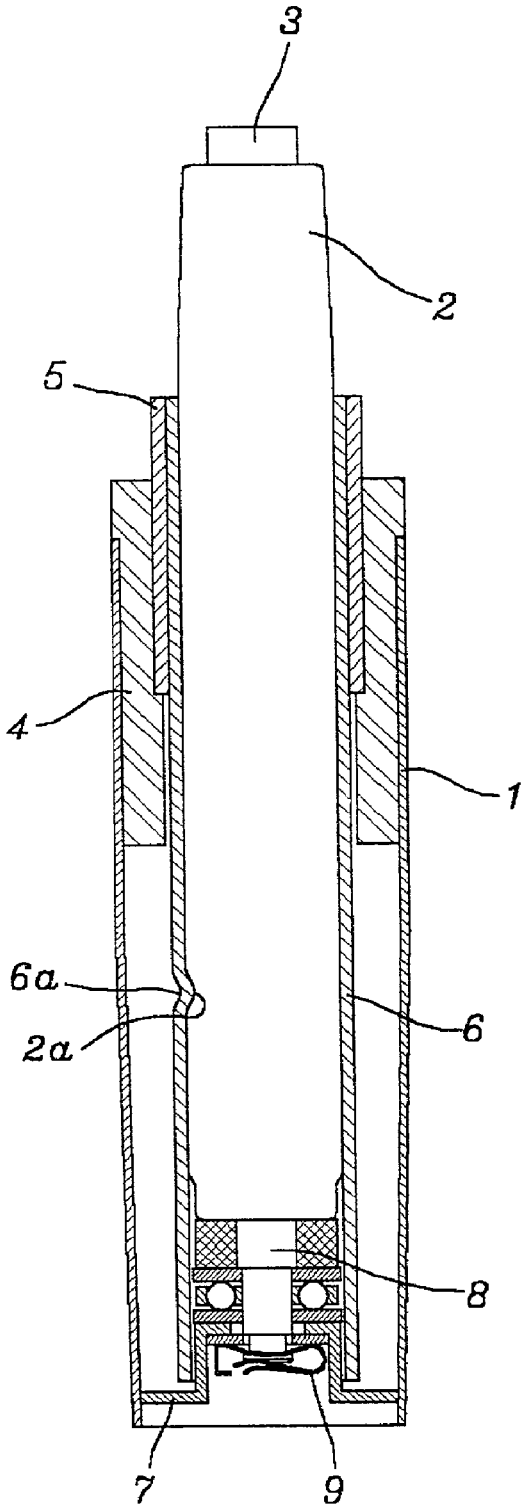
FIG. 1 is a view for showing a column unit according to the first preferred embodiment of the present invention at the minimum stroke position.

Hereinafter, preferred embodiments of the present invention will be explained in detail with reference to the attached drawings.

The first preferred embodiment of a column unit according to the present invention is shown in FIGS. 1 to 5. As shown in the figures, the column unit according to the present invention is installed vertically at a base of a chair at which a wheel is installed. A spindle 2 is installed at a cylindrical base tube (1) which has a cavity at the central portion of the column unit.

The interior of the spindle 2 is filled with a pressure gas. The spindle 2 is divided into upper and lower chambers by a piston. The piston is connected to a piston rod 8 the lower end of which is rotatably connected to a rod supporter 7, which in one embodiment may have a hat shape as shown. The supporter 7 is fixed to the lower end portion of the inner side of the base tube 1 by welding. A bearing is installed at the lower end portion of the piston rod 8 so that the spindle 2 is rotated. The upper and lower chambers of the spindle 2 are communicated by a 5 which connects the chambers. A valve 30 is installed at a predetermined position of the bypass 20, and is operated by a gas opening/closing pin 3.

Figure 3:
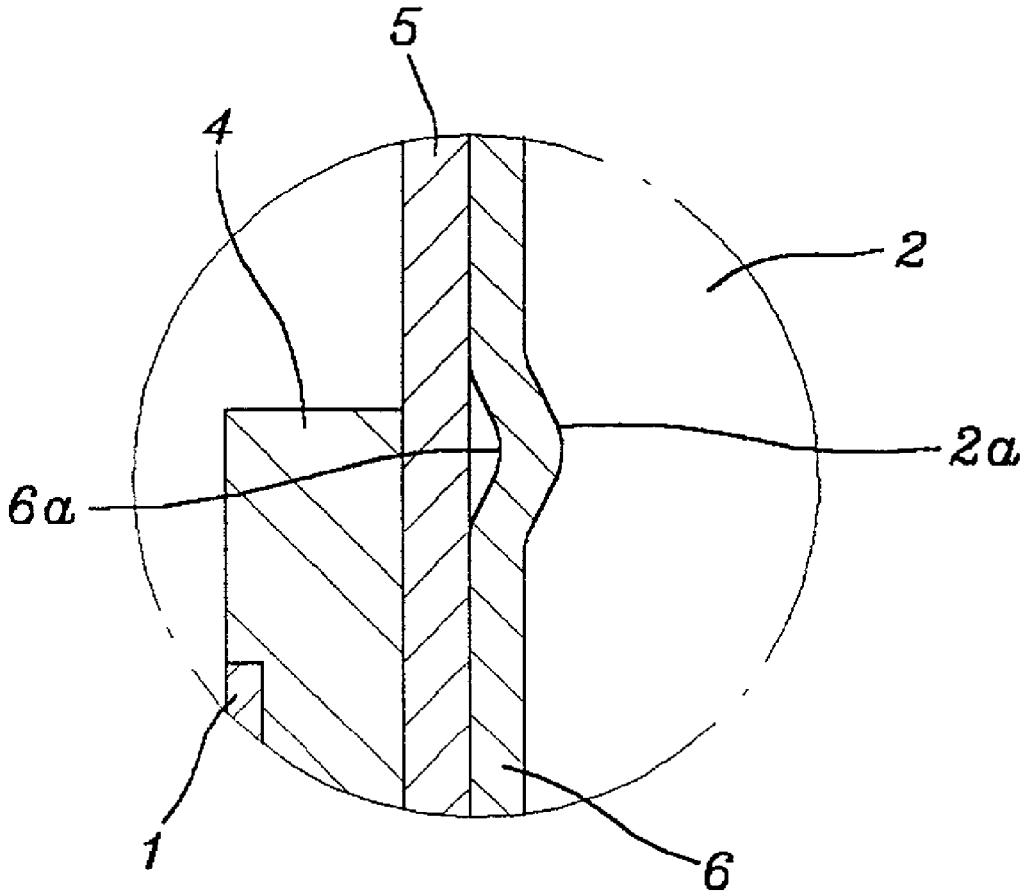
FIG. 3 is an enlarged view for showing the A portion shown in FIG. 2.

A cylindrical guide sleeve 6 having opened upper and lower portions is mounted to the outer surface of the spindle 2 by press-fitting. As shown in FIG. 3, in the state the spindle 2 is mounted to the inner surface of the guide sleeve 6, the guide sleeve 6 and the spindle 2 are struck by a strike to be recessed so that recessed portions 2*a* and 6*a* are formed. Therefore, when the spindle 2 is moved upward and downward, the guide sleeve 6 is integrally moved upward and downward.

The guide sleeve 6 is extended downwardly further than the lower end portion of the spindle 2 to increase the height of the spindle in the maximum stroke and to endure the moment applied at the upper end portion of the spindle 2.

Figure 4:
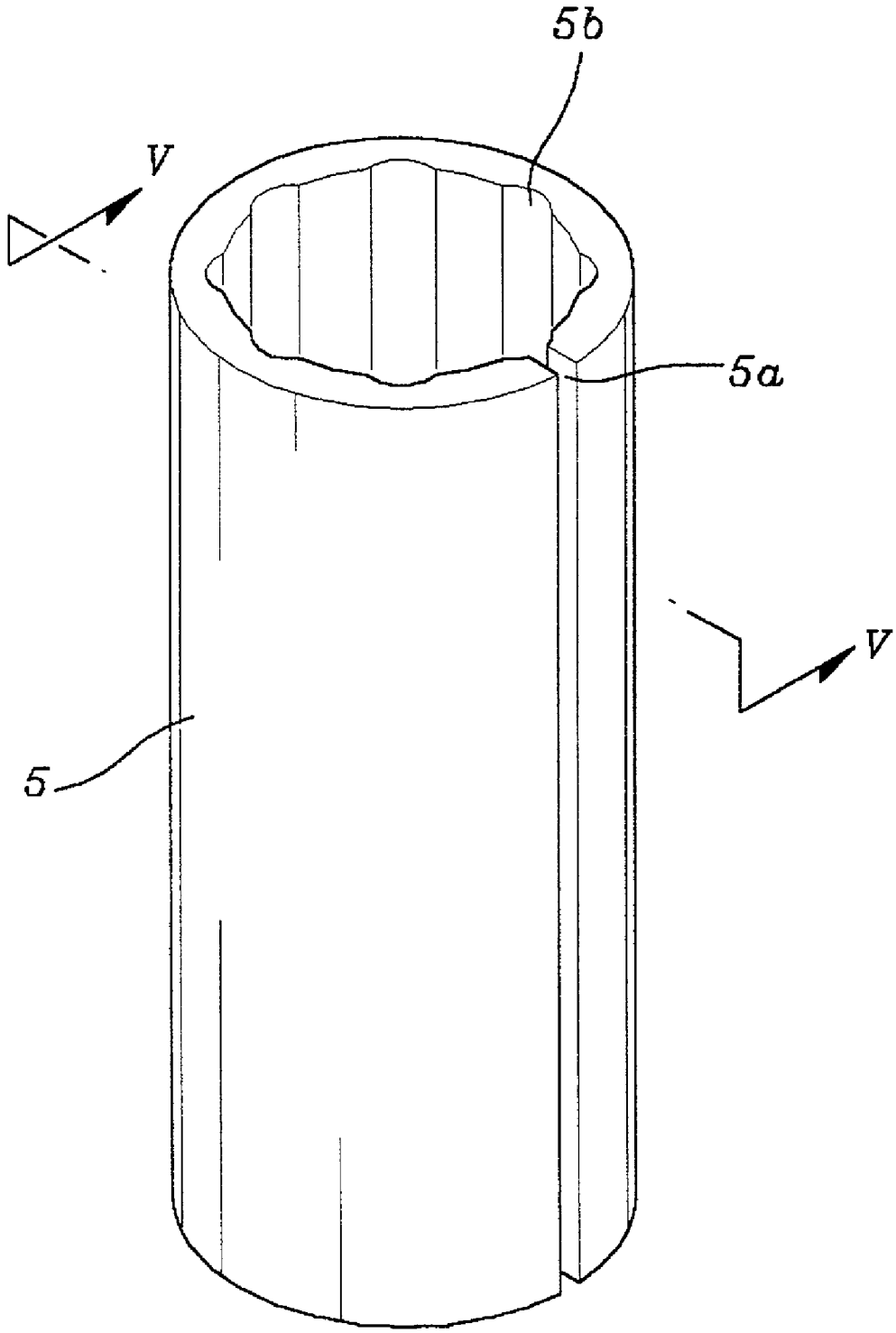
FIG. 4 is a perspective view for showing a bushing which is an element of the column unit according to the first preferred embodiment of the present invention.
Figure 5:
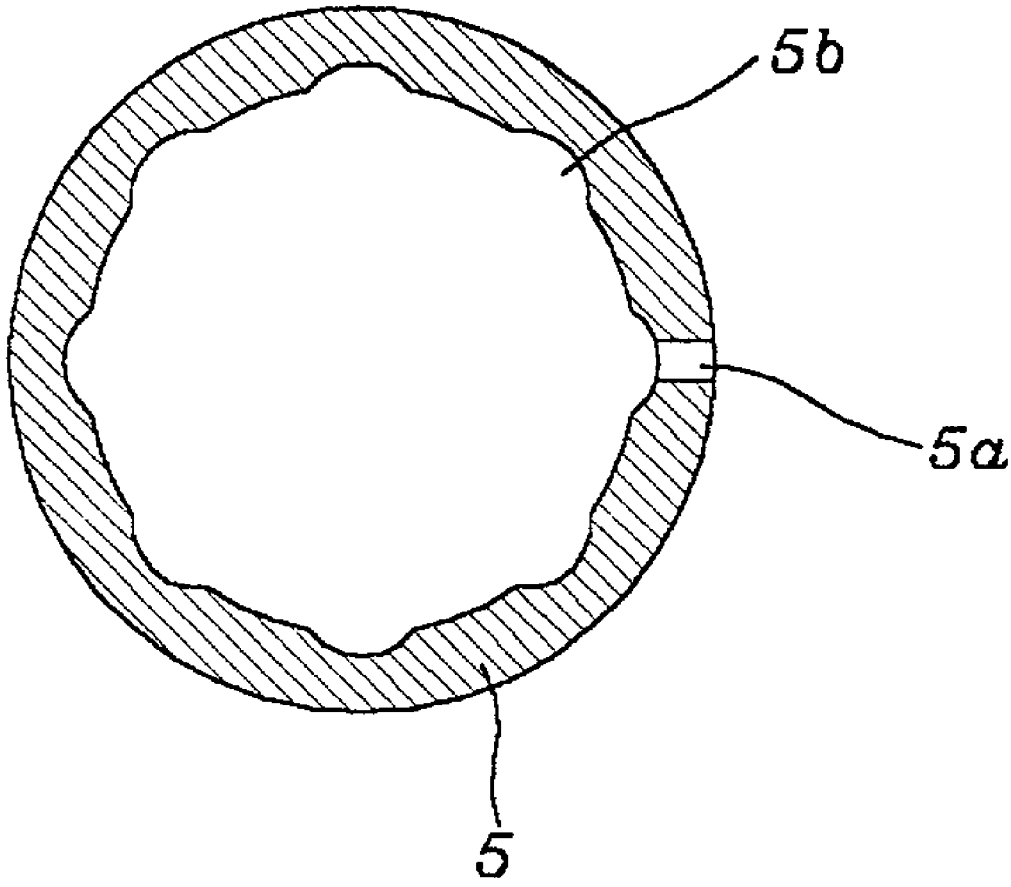
FIG. 5 is a cross-sectional view taken along the line V—V shown in FIG. 4.
Figure 6:
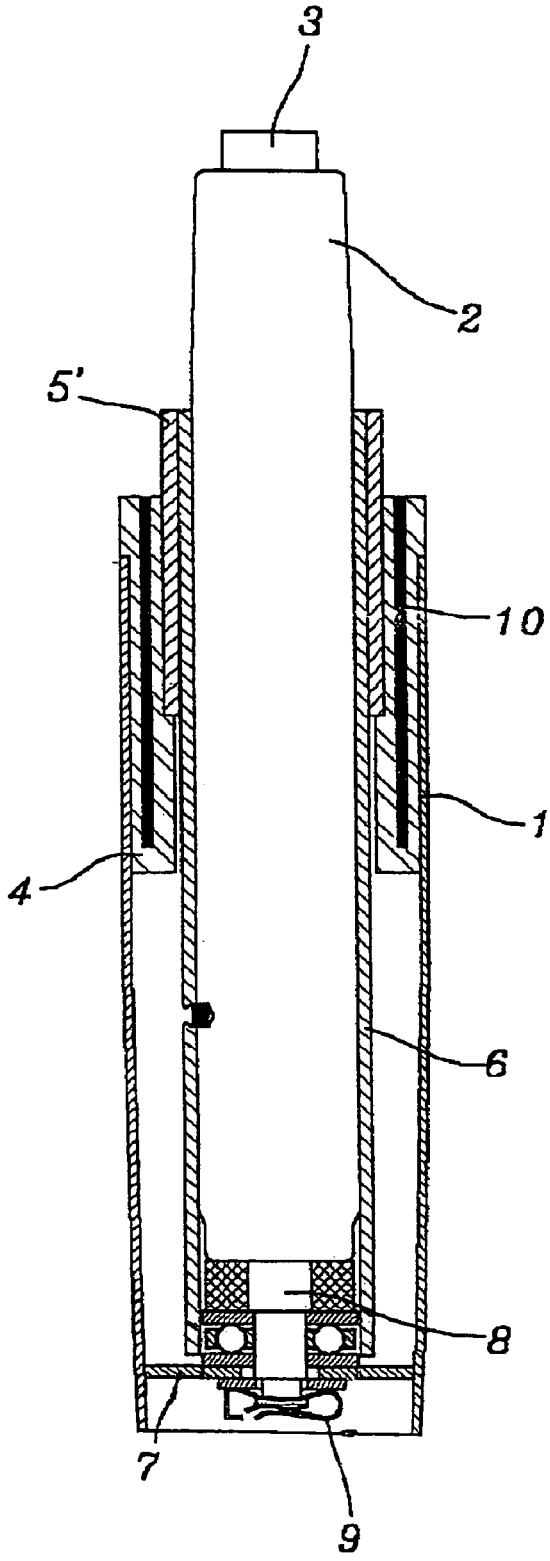
FIG. 6 is a view for showing a column unit according to the second preferred embodiment of the present invention at the minimum stroke position.
Figure 7:
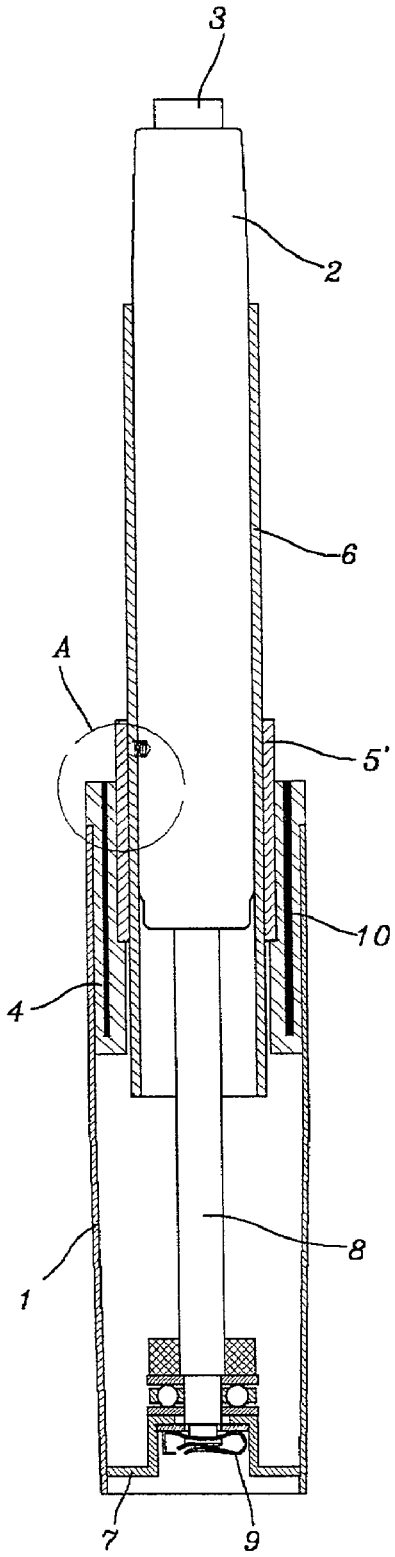
FIG. 7 is a view for showing the column unit of FIG. 6 at the maximum stroke position.

A cylindrical bushing 5 having opened upper and lower portions is installed on the outer surface of the guide sleeve 6. The bushing 5 guides the upward and downward movements of the spindle 2 like the guide sleeve 6, and provides a support force which can endures the moment applied at the upper end of the spindle 2 at the maximum strike position of the column unit. Therefore, even if the force applied to the spindle 2 is not applied vertically when the spindle 2 starts to move downwardly at the maximum stroke position, the spindle 2 is easily moved downward by the guide of the bushing 5. Further, since a lubricant is coated on the inner surface of the bushing 5, the spindle 2 is easily moved upward and downward. As shown in FIGS. 4 and 5, since a recess 5*b* is formed on the inner surface of the bushing 5, the frictional area is reduced and the spindle 2 is easily moved upward and downward. The recess 5*b* formed on the inner surface of the bushing 5 shown in FIGS. 4 and 5 is formed by using a circumference shape in the inner side arc.

$MoS_2$ or polyetraflourethylent is used as the lubricant coated on the inner surface of the bushing 5. The thickness of the lubricant is preferably 2 to 70 μm. The grease is supplied into the recess 5*b* formed on the inner surface of the bushing 5 to improve the lubricating effect.

In FIGS. 4 and 5, a cutting portion 5*a* is formed in the axial direction of the bushing 5 to facilitate the insertion when the bushing 5 is assembled.

A tube guide 4 is installed between the outer surface of the bushing 5 and the base tube 1.

According to the column unit of the first preferred embodiment of the present invention, if a user presses a gas opening/closing pin 3 at the minimum stroke position shown in FIG. 1, the upper and lower chambers divided by the piston is communicated through the bypass as the valve is opened. And, the piston is pushed downward by the gas pressure of the interior of the spindle 2 to raise the spindle 2.

If the force which presses the gas opening/closing pin 3 is removed when the spindle 2 is raised, the movement of the spindle 2 is stopped and the height of a chair sheet can be regulated. According to the present invention, as the guide sleeve 6 is raised together with the spindle 2 since the spindle 2 is initially raised, even when the spindle 2 is stopped after the spindle 2 is raised by a small distance, the guide sleeve 6 is stopped. Of course, the frictional force between the guide sleeve 6 and the bushing 5 is remarkably reduced by the operations of the bushing 5 and the lubricant to smoothly accomplish the operation of the guide sleeve.

Figure 2:
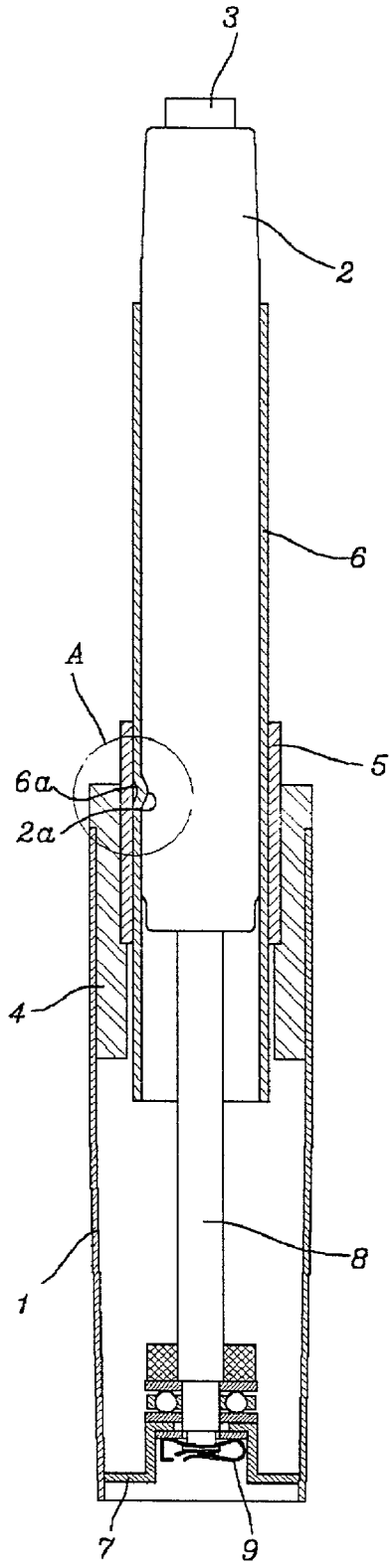
FIG. 2 is a view for showing the column unit of FIG. 1 at the maximum stroke position.

If the spindle 2 is raised further, it reaches the maximum stroke position as shown in FIG. 2, the spindle 2 and the guide sleeve 6 is integrally raised. Therefore, the longer stroke is more stably performed than the case in which the guide sleeve 6 is not provided.

In the above-mentioned state, if the user presses the gas opening/closing pin 3 and a force which can endure the gas pressure of the interior of the spindle 2 is applied, the spindle 2 is moved downward together with the guide sleeve 6. Then, if the force applied in the lower direction is vertically applied accurately, the spindle 2 and the guide sleeve 6 is smoothly moved downward. However, since a person sitting on the chair applies the force by using the weight of the person, the force is not vertically applied accurately and makes a predetermined angle with respect to the vertical line. For the reason, since conventionally an excessive stress is applied to a portion which makes contact with the guide sleeve 6 and the frictional force is increased, the spindle 2 and the guide sleeve 6 is not smoothly moved downward. However, according to the column unit of the present invention, since the bushing 5 is protruded to a predetermined height from the upper portion of the base tube 1, the spindle is moved downward by the guide of the bushing 5. Further, since the lubricant is coated on the inner surface of the bushing 5 and a plurality of recesses 5*b* for reducing the frictional area is formed, the spindle 2 and the guide sleeve 2 is more smoothly moved downward.

On the other hand, a column unit according to the second preferred embodiment of the present invention is shown in FIGS. 6 to 10. The second preferred embodiment of the present invention differs from the first preferred embodiment of the present invention in that an auxiliary pipe 10 made of a metal is inserted into the tube guide 4.

According to the column unit of the second preferred embodiment of the present invention, a through-hole 6*b* into which a screw 11 is engaged is formed in the guide sleeve 6 so that the guide sleeve 6 is moved together with the spindle 2. A screw recess 2*b* is formed in the spindle 2 so that the screw 11 is inserted into the screw recess 2*b*. After the screw 11 is engaged with the through-hole 6*b* and the screw recess 2*b*, the inlet portion of the through-hole 6*b* is collapsed by a stroke to thereby form at least one catching jaw 6*c* to prevent the separation of the screw.

According to the column unit of the second preferred embodiment of the present invention, the shape of a recess 5*b*' of a bushing 5' installed between the guide sleeve 6 and the tube guide 4 differs from the first preferred embodiment of the present invention.

The operation of the column unit according to the second preferred embodiment of the present invention is the same as that of the first preferred embodiment.

Namely, since the guide sleeve 6 is integrally moved upward and downward together with the spindle 2, the guide sleeve 6 effectively performs the guiding and supporting. Further, the bushing 5' is installed to smoothly move the spindle 2 upward and downward.

Figure 8:
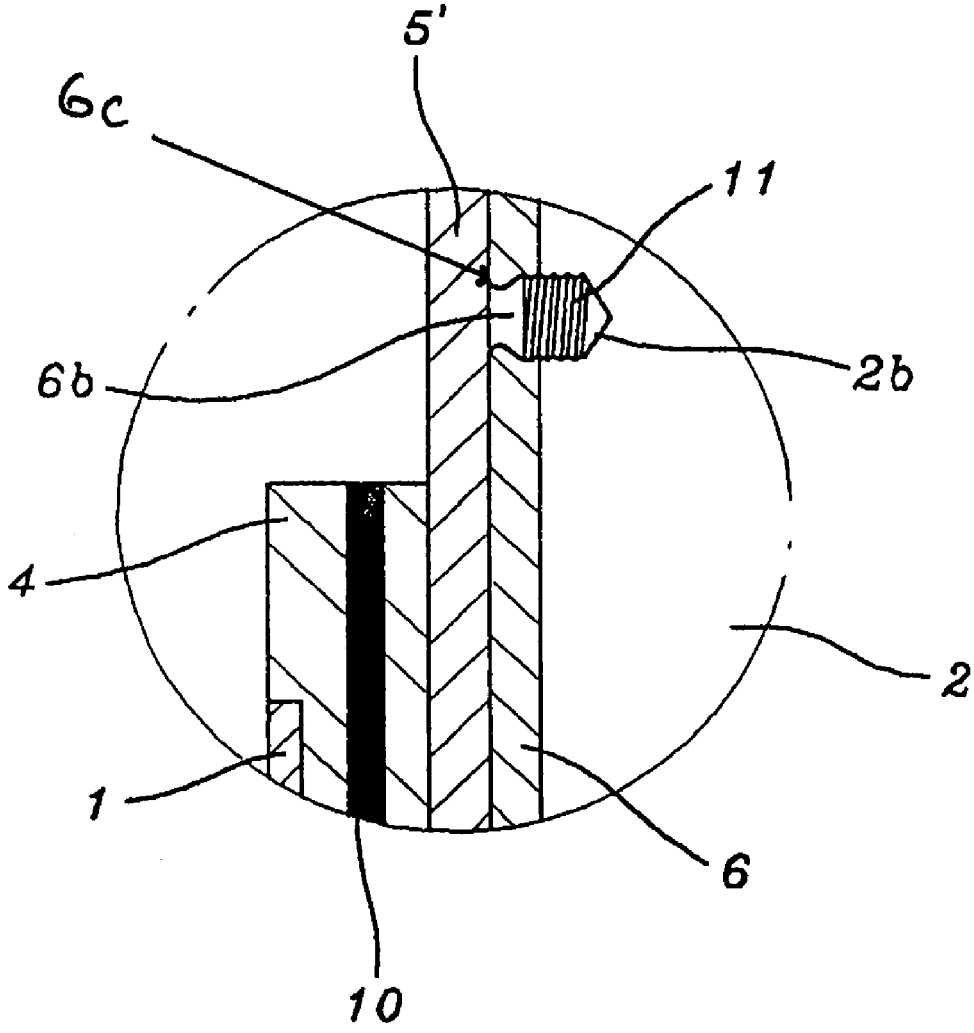
FIG. 8 is an enlarged view for showing the B portion shown in FIG. 7.

FIG. 8 is a view for showing in detain a structure by which the spindle 2 and the guide sleeve 6 are integrally moved upward and downward. As shown in the figure, the screw 11 is passed through the penetrating hole 6*b* formed in the guide sleeve 6 and is engaged with the screw recess 2*b* of the spindle 2. The inlet portion of the penetrating hole 6*b* is collapsed after the screw 11 is engaged with the penetrating hole 6*b*.

In the preferred embodiment, the screw 11 is engaged with the penetrating hole 6*b* and the screw recess 2*b*, but a pin of a predetermined length can be used.

Figure 9:
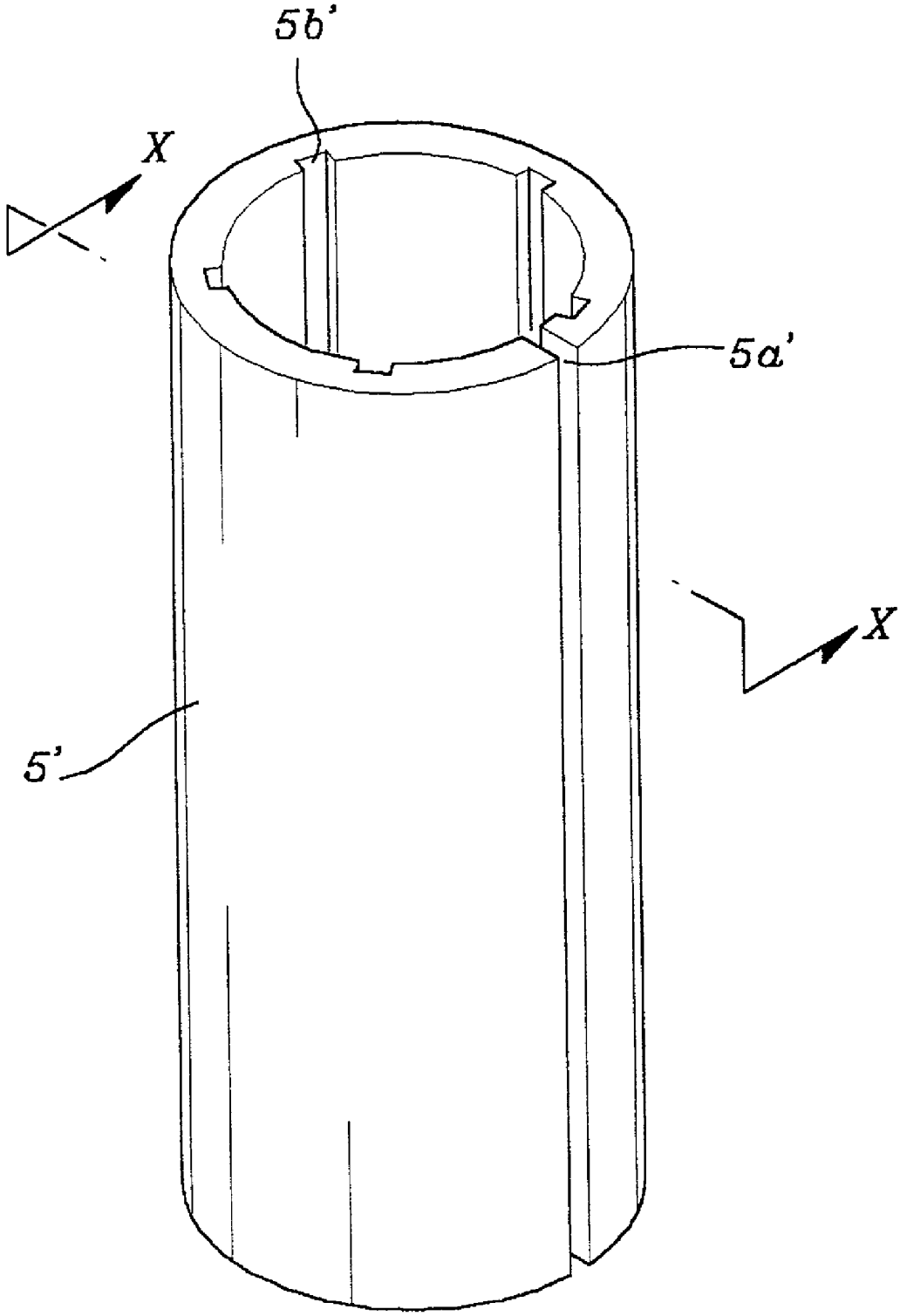
FIG. 9 is a perspective view for showing a bushing which is an element of the column unit according to the second preferred embodiment of the present invention.
Figure 10:
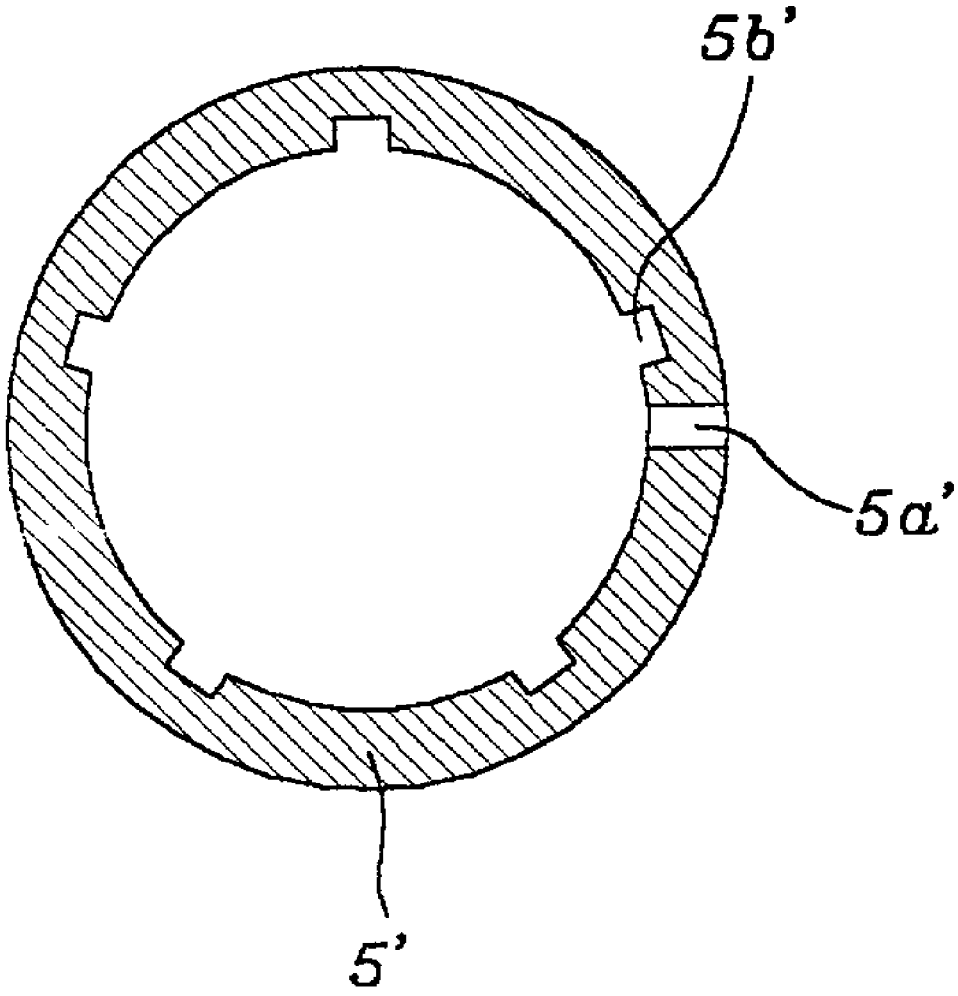
FIG. 10 is a cross-sectional view taken along the line X—X shown in FIG. 9.

FIGS. 9 and 10 are views for showing the bushing 5' of the column unit according to the second preferred embodiment of the present invention. A cutting portion 5*a*' having a portion cut off along the axial direction to facilitate the assembling is formed in the bushing 5'. A long recess 5*b*' is formed along the axial direction of the bushing on the inner side of the bushing. It is preferable that the inner surface of the bushing 5' is coated with a lubricant and the grease is filled in the recesses 5*b*'.

As stated above, preferred embodiments of the present invention are shown and described. Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A column unit comprising:

a base tube having a lower end portion vertically fixed to a base of a chair and having a hollow interior;

a spindle having an interior filled with a pressure gas and divided into upper and lower chambers by a piston, an upper end portion of a piston rod being connected to the piston, a lower end portion of the piston rod being rotatably installed at the lower end portion of the inner side of the base tube so as to rotate relative to the lower end portion of the base tuber the spindle including a recess; and a guide sleeve installed between the base tube and the spindle and engaged with the recess of the spindle so as to be integrally moved upward and downward together with the spindle through an entire movement of the guide sleeve.

2. A column unit according to claim 1, wherein a penetrating hole is formed at a predetermined position in the guide sleeve corresponding to the recess formed at a position of the spindle and a screw is inserted through the penetrating hole into the recess to be engaged so that the spindle is integrally moved together with the guide sleeve.

3. A column unit according to claim 1, a penetrating hole is formed at a predetermined position in the guide sleeve corresponding to the recess formed in the spindle and a pin is inserted through the penetrating hole into the recess so that the spindle is integrally moved together with the guide sleeve.

4. A column unit according to claim 3, wherein the pin is passed through the penetrating hole and is completely engaged with the recess, and an inlet portion of the penetrating hole is pressed inside thereby forming a catching jaw so that the pin is not separated.

5. A column unit comprising:

a base tube having a lower end portion vertically fixed to a base of a chair and having a hollow interior;

a spindle having an interior filled with a pressure gas and divided into upper and lower chambers by a piston, an upper end portion of a piston rod being connected to the piston, a lower end portion of the piston rod being rotatably installed at the lower end portion of the inner side of the base tube, the upper and lower chambers being communicated by a bypass, a valve being installed at the bypass; and a guide sleeve installed between the base tube and the spindle and engaged with the spindle to be integrally moved upward and downward together with the spindle;

a penetrating hole is formed at a predetermined position in the guide sleeve;

a recess formed at a position of the spindle corresponding to the penetrating hole;

a screw or pin inserted through the penetrating hole into the recess to be engaged so that the spindle is integrally moved together with the guide sleeve, wherein the screw or the pin is passed through the penetrating hole and is completely engaged with the recess, and an inlet portion of the penetrating hole is pressed inside thereby forming a catching jaw so that the screw or the pin is not separated.

6. A column unit comprising:

a base tube having a lower end portion vertically fixed to a base of a chair and having a hollow interior;

a spindle having an interior filled with a pressure gas and divided into upper and lower chambers by a piston, an upper end portion of a piston rod being connected to the piston, a lower end portion of the piston rod being rotatably installed at the lower end portion of the inner side of the base tube, the upper and lower chambers being communicated by a bypass, a valve being installed at the bypass; and a bushing fixed between the base tube and the spindle and installed at a position higher than the base tube, wherein at least one recess is formed along the axial direction of the bushing on the inner side of the bushing so that the frictional area with the spindle is reduced.

7. A column unit according to claim 6, wherein at least one of the at least one recess comprises plurally formed recesses and the recesses are regularly formed at a predetermined angle.

8. A column unit according to claim 6, wherein grease is filled in the at least one recess.

9. A column unit comprising:

a base tube having a lower end portion vertically fixed to a base of a chair and having a hollow interior;

a spindle having an interior filled with a pressure gas and divided into upper and lower chambers by a piston, an upper end portion of a piston rod being connected to the piston, a lower end portion of the piston rod being rotatably installed at the lower end portion of the inner side of the base tube, the spindle including a recess:

a guide sleeve installed between the base tube and the spindle and engaged with the recess of the spindle so as to be integrally moved upward and downward together with the spindle through an entire movement of the guide sleeve:

a bushing positioned between the guide sleeve and the base tube, wherein the bushing includes recesses on an interior circumference for reducing frictional area between the bushing and the guide sleeve.

* * * * *